US009688295B2

(12) United States Patent
Fanara et al.

(10) Patent No.: US 9,688,295 B2
(45) Date of Patent: Jun. 27, 2017

(54) TRAINLINE NETWORK ACCESS POINT FOR PARALLEL COMMUNICATION

(71) Applicants: Electro-Motive Diesel, Inc., La Grange, IL (US); Secure Communications Systems Inc., Santa Ana, CA (US)

(72) Inventors: Mark Alan Fanara, Blue Springs, MO (US); Neil Keith Habermehl, Irvine, CA (US)

(73) Assignees: ELECTRO-MOTIVE DIESEL, INC., LaGrange, IL (US); SECURE COMMUNICATIONS SYSTEMS, INC., Santa Ana, CA (US)

( * ) Notice: Subject to any disclaimer, the term of this patent is extended or adjusted under 35 U.S.C. 154(b) by 324 days.

(21) Appl. No.: 13/974,742

(22) Filed: Aug. 23, 2013

(65) Prior Publication Data

US 2015/0057848 A1 Feb. 26, 2015

(51) Int. Cl.
*B61L 15/00* (2006.01)
*B61C 17/12* (2006.01)

(52) U.S. Cl.
CPC ..... *B61L 15/0036* (2013.01); *B61C 17/12* (2013.01); *B61L 15/0072* (2013.01)

(58) Field of Classification Search
CPC ... B61L 15/0036; B61L 15/0072; B61C 17/12
See application file for complete search history.

(56) References Cited

U.S. PATENT DOCUMENTS 3,093,802 A 6/1963 Chow
4,012,603 A 3/1977 Araseki et al.
(Continued)

FOREIGN PATENT DOCUMENTS

DE 421 4821 11/1992
DE 195 01 887 7/1995
(Continued)

OTHER PUBLICATIONS

Amirshahi, Pouyan, et al., "High-Frequency Characteristics of Overhead Multiconductor Power Lines for Broadband Communications," IEEE Journal on Selected Areas in Communications, vol. 24, No. 7, Jul. 2006, p. 1292.
(Continued)

*Primary Examiner* — Jerrah Edwards
*Assistant Examiner* — Donald J Wallace

(57) ABSTRACT

A trainline network access point connected to an intra-consist electrical cable of a consist has a network data signal path, first and second communication modules, and a network switch. The network switch is connected to the first and second communication modules and configured to selectively connect the network data signal path to the first communication module and the second communication module. The first communication module has a first processor configured to receive first network data via the network data signal path, modulate the first network data for transmission over the intra-consist electrical cable, and transmit the first modulated network data over the intra-consist electrical cable. The second communication module includes a second processor configured to receive second network data via the network data signal path, modulate the second network data for transmission over the intra-consist electrical cable, and transmit the second modulated network data over the intra-consist electrical cable.

17 Claims, 4 Drawing Sheets

(56) References Cited

U.S. PATENT DOCUMENTS

| | | | | |
|---|---|---|---|---|
| 4,383,243 | A | 5/1983 | Kruegel et al. | |
| 4,556,866 | A | 12/1985 | Gorecki | |
| 4,578,818 | A | 3/1986 | Claydon | |
| 4,721,923 | A | 1/1988 | Bares et al. | |
| 4,724,396 | A | 2/1988 | Taylor, Jr. et al. | |
| 4,815,106 | A | 3/1989 | Propp et al. | |
| 4,860,308 | A | 8/1989 | Kamerman et al. | |
| 5,351,272 | A | 9/1994 | Abraham | |
| 5,446,918 | A | 8/1995 | Lamy | |
| 5,651,517 | A | 7/1997 | Stevens et al. | |
| 5,706,191 | A | 1/1998 | Bassett et al. | |
| 5,717,685 | A | 2/1998 | Abraham | |
| 5,777,545 | A | 7/1998 | Patel et al. | |
| 5,777,547 | A | 7/1998 | Waldrop | |
| 5,818,127 | A | 10/1998 | Abraham | |
| 5,969,643 | A | 10/1999 | Curtis | |
| 5,986,577 | A | 11/1999 | Bezos | |
| 6,114,974 | A | 9/2000 | Halvorson | |
| 6,163,089 | A | 12/2000 | Kull | |
| 6,311,045 | B1 | 10/2001 | Domokos | |
| 6,373,375 | B1 | 4/2002 | Hoetzel et al. | |
| 6,392,368 | B1 | 5/2002 | Deller et al. | |
| 6,392,562 | B1 | 5/2002 | Boston et al. | |
| 6,408,766 | B1 | 6/2002 | McLaughlin et al. | |
| 6,421,587 | B2 | 7/2002 | Diana et al. | |
| 6,442,195 | B1 | 8/2002 | Liu et al. | |
| 6,490,523 | B2 | 12/2002 | Doner | |
| 6,493,341 | B1 * | 12/2002 | Datta | H04L 12/5692 370/392 |
| 6,553,838 | B2 | 4/2003 | Amini | |
| 6,567,648 | B1 | 5/2003 | Ahn et al. | |
| 6,587,739 | B1 | 7/2003 | Abrams et al. | |
| 6,595,045 | B1 | 7/2003 | Fuglewicz et al. | |
| 6,972,670 | B2 | 12/2005 | LaDuc et al. | |
| 6,995,658 | B2 | 2/2006 | Tustison et al. | |
| 7,006,523 | B2 | 2/2006 | Binder | |
| 7,021,588 | B2 | 4/2006 | Hess, Jr. et al. | |
| 7,113,752 | B2 | 9/2006 | Leinonen et al. | |
| 7,182,411 | B2 | 2/2007 | Levy et al. | |
| 7,206,320 | B2 | 4/2007 | Iwamura | |
| 7,336,156 | B2 | 2/2008 | Arita et al. | |
| 7,499,682 | B2 | 3/2009 | Rozenblit et al. | |
| 7,634,240 | B2 | 12/2009 | Milzlaff et al. | |
| 7,893,557 | B2 | 2/2011 | Davis et al. | |
| 7,933,420 | B2 | 4/2011 | Copley et al. | |
| 8,036,402 | B2 | 10/2011 | Furge | |
| 8,068,616 | B2 | 11/2011 | Copley et al. | |
| 8,140,027 | B2 | 3/2012 | Ozgun et al. | |
| 8,160,520 | B2 | 4/2012 | Srinivasan et al. | |
| 8,232,666 | B2 | 7/2012 | Rocamora et al. | |
| 8,305,229 | B1 | 11/2012 | Gard | |
| 8,306,489 | B2 | 11/2012 | Schwarzmueller et al. | |
| 8,340,318 | B2 | 12/2012 | Copley et al. | |
| 8,364,189 | B2 | 1/2013 | Mintah et al. | |
| 8,447,255 | B2 | 5/2013 | Asokan | |
| 2002/0011923 | A1 | 1/2002 | Cunningham et al. | |
| 2002/0101882 | A1 | 8/2002 | Kim | |
| 2002/0167398 | A1 | 11/2002 | Strasser | |
| 2003/0195668 | A1 | 10/2003 | Radtke et al. | |
| 2004/0223275 | A1 | 11/2004 | Yanagida et al. | |
| 2004/0261101 | A1 * | 12/2004 | Iwamura | H04B 3/542 725/32 |
| 2005/0013320 | A1 * | 1/2005 | Binder | H04B 3/54 370/463 |
| 2005/0085259 | A1 | 4/2005 | Conner et al. | |
| 2005/0143868 | A1 | 6/2005 | Whelan | |
| 2006/0025903 | A1 | 2/2006 | Kumar | |
| 2006/0170285 | A1 | 8/2006 | Morimitsu et al. | |
| 2007/0136050 | A1 | 6/2007 | Tourwe | |
| 2007/0282494 | A1 | 12/2007 | Moffitt et al. | |
| 2007/0286079 | A1 | 12/2007 | Mollenkopf et al. | |
| 2008/0003962 | A1 * | 1/2008 | Ngai | H03F 1/0205 455/179.1 |
| 2008/0195259 | A1 | 8/2008 | Davis et al. | |
| 2008/0211663 | A1 | 9/2008 | Mansfield et al. | |
| 2008/0298384 | A1 | 12/2008 | Beaucage | |
| 2009/0042436 | A1 | 2/2009 | Emoto et al. | |
| 2009/0287496 | A1 | 11/2009 | Thyssen et al. | |
| 2010/0045447 | A1 * | 2/2010 | Mollenkopf | G02B 6/483 340/538 |
| 2010/0235022 | A1 | 9/2010 | Siddappa et al. | |
| 2010/0241295 | A1 * | 9/2010 | Cooper | B61L 15/0036 701/19 |
| 2010/0256842 | A1 | 10/2010 | Liberatore | |
| 2011/0093144 | A1 | 4/2011 | Goodermuth et al. | |
| 2012/0095580 | A1 | 4/2012 | Zhang | |
| 2012/0163201 | A1 | 6/2012 | Williams et al. | |
| 2013/0038424 | A1 * | 2/2013 | Katar | H04L 67/125 340/5.8 |
| 2013/0077801 | A1 | 3/2013 | Tarnowski | |
| 2013/0271342 | A1 | 10/2013 | Shen | |
| 2013/0320154 | A1 | 12/2013 | Brown | |
| 2013/0323939 | A1 | 12/2013 | Brown | |
| 2014/0286445 | A1 * | 9/2014 | Schneider | H04L 1/0606 375/257 |
| 2015/0103809 | A1 * | 4/2015 | Karimi | H04W 52/246 370/336 |

FOREIGN PATENT DOCUMENTS

| | | |
|---|---|---|
| DE | 100 44 088 | 4/2002 |
| DE | 202007008825 | 8/2007 |
| EP | 0 968 897 | 1/2000 |
| EP | 1 010 602 | 6/2000 |
| EP | 1 065 127 | 1/2001 |
| EP | 1 253 725 | 10/2002 |
| EP | 1 306 283 | 5/2003 |
| EP | 1 487 128 | 12/2004 |
| GB | 109 7125 | 12/1967 |
| GB | 2 450 520 | 12/2008 |
| JP | 07/508609 | 9/1995 |
| JP | 11/317697 | 11/1999 |
| JP | 2004/235752 | 8/2004 |
| JP | 2004/241997 | 6/2005 |
| JP | 2005/176131 | 6/2005 |
| WO | WO 94/01949 | 1/1994 |
| WO | WO 2004/054224 | 6/2004 |
| WO | WO 2006/075767 A3 | 7/2006 |

OTHER PUBLICATIONS

Carcelle, Xavier, "Power Line Communications in Practice," Hybrid PLC (2009), p. 304.

Dai, Huaiyu, et al., "Advanced Signal Processing for Power Line Communications," *IEEE Communications Magazine*, May 2003, p. 100.

Hailes, S., "Modern telecommunications systems for train control," The 11th IET Professional Development Course on Railway Signalling and Control Systems, Jun. 2006, pp. 185-192.

IEEE Standard for Communications Protocol Aboard Trains, IEEE Std 1473-1999.

Kamata, Keiichi, "T-Ethernet: The Next International Standard Candidate for Train Communication Network." 2008.

Kirrmann, Hubert, et al., "The IEC/IEEE Train Communication Network," IEEE (2001).

Latchman, Haniph A., et al., "Homeplug AV and IEEE 1901: A Handbook for PLC Designers and Users," IEEE Press, p. 316.

Liu, Er, et al., "Broadband Powerline Channel and Capacity Analysis," IEEE (2005) p. 7.

Liu, Er, et al., "Powerline Communication Over Special Systems," IEEE (2005), p. 167.

"Nexans signaling cable enhances," *Railway Gazette International*; Apr. 2006; 162, 4; ProQuest, p. 206.

PM4380 Analog Front End for VDSL2/ADSL2+, Preliminary Product Brief, PMC-2060187, Issue 3, PMC-Sierra, Inc. (2007).

Roden, Andrew, "Duotrack signals S&T cabling revolution," *International Railway Journal*; Jul. 2007; 47, 7; ABI/INFORM Complete, p. 38.

Russo, D., et al., "A New Approach for Train Passenger Information Systems," presented at WCRR 2008 Seoul Korea, May 18-22, 2008.

(56) References Cited

OTHER PUBLICATIONS

Swanson, John D., "Advanced Light Rail Vehicle Communication Systems Design," Proceedings of the 2004 ASME/IEEE Joint Rail Conference, Apr. 6-8, 2004, p. 213.
Trainline communications—trainline communication system specifications—Vehicle Track Systems Newletter, *Railway Age*, Dec. 1994.
U.S. Appl. No. 13/563,220 by Aaron Gamache Foege et al., filed Jul. 31, 2012, entitled "Fuel Distribution System for Multi-Locomotive Consist".
U.S. Appl. No. 13/690,239 by James Robert Luecke et al., filed Nov. 30, 2012, entitled "Data Communication Systems and Methods for Locomotive Consists".
U.S. Appl. No. 13/903,367 by Tom Otsubo et al., filed May 24, 2013, entitled "Communication System for Use with Train Consist".
U.S. Appl. No. 13/903,395 by Tom Otsubo et al., filed May 24, 2013 entitled "Locomotive/Tender Car Communication System".
U.S. Appl. No. 14/250,613 by Neil Keith Habermehl, filed Apr. 11, 2014, entitled "Train Communication Network."
U.S. Appl. No. 14/250,586 by Neil Keith Habermehl, filed Apr. 11, 2014, entitled "Train Communication Network."
U.S. Appl. No. 14/250,641 by Neil Keith Habermehl, filed Apr. 11, 2014, entitled "Train Communication Network."

* cited by examiner

TRAINLINE NETWORK ACCESS POINT FOR PARALLEL COMMUNICATION

TECHNICAL FIELD

The present disclosure relates generally to a trainline network access point, and more particularly, to a trainline network access point for parallel communication in a locomotive consist.

BACKGROUND

A consist includes one or more locomotives that are coupled together to produce motive power for a train of rail vehicles. The locomotives each include one or more engines, which combust fuel to produce mechanical power. The engine(s) of each locomotive can be supplied with liquid fuel (e.g., diesel fuel) from an onboard tank, gaseous fuel (e.g., natural gas) from a tender car, or a blend of the liquid and gaseous fuels. The mechanical power produced by the combustion process is directed through a generator and used to generate electricity. The electricity is then routed to traction motors of the locomotives, thereby generating torque that propels the train. The locomotives can be connected together at the front of the train or separated and located at different positions along the train. For example, the consist can be positioned at the front, middle, or end of the train. In some instances, more than one consist can be included within a single train. The locomotives in a consist can be oriented in a forward-facing (or "long hood") direction or a backward-facing (or "short hood") direction. In some consists, the locomotives include computer systems for maintaining operations of the locomotive. These computer systems are sometimes disposed on the long hood side of the locomotive.

Because the locomotives of a consist must cooperate to propel the train, communication between the locomotives can be important. Historically, this communication has been facilitated through the use of an MU (Multi-Unit) cable that extends along the length of the consist. An MU cable is comprised of many different wires, each capable of carrying a discrete signal used to regulate a different aspect of consist operation. For example, a lead locomotive generates current within a particular one of the wires to indicate a power level setting requested by the train operator. When this wire is energized, the engines of all trail locomotives are caused to operate at a specific throttle value. In another example, when one locomotive experiences a fault condition, another of the wires is energized to alert the other locomotives of the condition's existence.

Although acceptable in some applications, the information traditionally transmitted via the MU cable may be insufficient in other applications. For example, during the fault condition described above, it can be important to know a severity and/or cause of the fault condition so that an appropriate response to the fault condition can be implemented in an effective and efficient manner. Additionally, as consist configurations become more complex, for example during multi-unit blended fuel operations (i.e., operations where gaseous fuel from a tender car is simultaneously supplied to multiple locomotives and mixed with diesel fuel at different rates), control of the locomotives and/or the tender car may require a greater amount of cooperation and/or more complex communication than can be provided via the MU cable.

One attempt to address the above-described problems is disclosed in U.S. Patent Publication 2010/0241295 of Cooper et al. that published on Sep. 23, 2010 ("the '295 publication"). Specifically, the '295 publication discloses a consist having a lead locomotive and one or more trail locomotives connected to each other via an MU cable. Each locomotive includes a computer unit, which, along with the MU cable, forms an Ethernet network in the train. With this configuration, network data can be transmitted from the computer unit in the lead locomotive to the computer units in the trail locomotives. The network data includes data that is packaged in packet form as data packets and uniquely addressed to particular computer units. The network data can be vehicle sensor data indicative of vehicle health, commodity condition data, temperature data, weight data, and security data. The network data is transmitted orthogonal to conventional non-network (i.e., command) data that is already being transmitted on the MU cable.

While the consist of the '295 publication may have improved communication between locomotives, it may still be less than optimal. In particular, multiple packets of network data cannot be transmitted in parallel, and as a result optimal performance is not realized. The system of the present disclosure solves one or more of the problems set forth above and/or other problems with existing technologies.

SUMMARY

A trainline network access point connected to an intra-consist electrical cable of a consist includes a network data signal path, a first communication module, a second communication module, and a network switch. The network switch is connected to the first communication module and the second communication module and configured to selectively connect the network data signal path to the first communication module and the second communication module. The first communication module has a first processor configured to receive first network data via the network data signal path, modulate the first network data for transmission over the intra-consist electrical cable, and transmit the first modulated network data over the intra-consist electrical cable. The second communication module includes a second processor configured to receive second network data via the network data signal path, modulate the second network data for transmission over the intra-consist electrical cable, and transmit the second modulated network data over the intra-consist electrical cable.

In another aspect, the present disclosure is directed to a method of transmitting data over an intra-consist electrical cable using a trainline network access point having a first communication module, a second communication module, and a network switch. The method includes receiving first network data and second network data. The method further includes selectively sending the first network data to the first communication module using the network switch, modulating the first network data for transmission over the intra-consist electrical cable with the first communication module, and transmitting the modulated first network data over the intra-consist electrical cable. The method also includes selectively sending the second network data to the second communication module using the network switch, modulating the second network data for transmission over the intra-consist electrical cable with the second communication module, and transmitting the modulated second network data over the intra-consist electrical cable.

DETAILED DESCRIPTION

Figure 1:
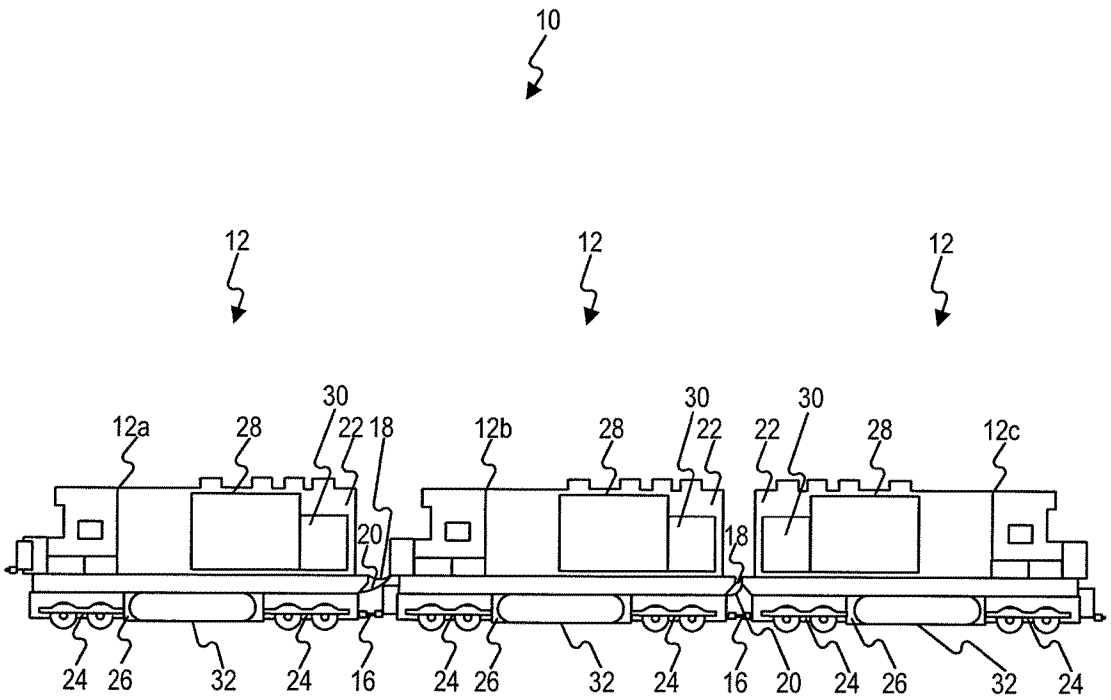
FIG. 1 is a pictorial illustration of an exemplary disclosed consist.

FIG. 1 illustrates an exemplary train consist 10 having one or more locomotives 12. In the disclosed embodiment, consist 10 has three different locomotives 12, including a lead locomotive 12*a* and two trailing locomotives 12*b*, 12*c*. It is contemplated, however, that consist 10 can include any number of locomotives 12 and other cars (e.g. tender cars), and that locomotives 12 can be located in any arrangement and in any orientation (e.g., forward-facing or rear-facing). Consist 10 can be located at the front of a train of other rail vehicles (not shown), within the train of rail vehicles, or at the end of the train of rail vehicles. It is also contemplated that more than one consist 10 can be included within a single train of rail vehicles, if desired, and/or that consist 10 can travel at times without a train of other rail vehicles.

Each locomotive 12 can be connected to an adjacent locomotive 12 in several different ways. For example, locomotives 12 can be connected to each other via a mechanical coupling 16, one or more fluid couplings 18, and one or more electrical couplings 20. Mechanical coupling 16 can be configured to transmit tractive and braking forces between locomotives 12. Fluid couplings 18 may be configured to transmit fluids (e.g., fuel, coolant, lubrication, pressurized air, etc.) between locomotives 12. Electrical couplings 20 can be configured to transmit power and/or data (e.g., data in the form of electrical signals) between locomotives 12. In one example, electrical couplings 20 include an intra-consist electrical cable, such as a MU cable, configured to transmit conventional command signals and/or electrical power. In another example, electrical couplings 20 include a dedicated data link configured to transmit packets of data (e.g., Ethernet data). In yet another example, the data packets can be transmitted via the intra-consist electrical cable. It is also contemplated that some data can be transmitted between locomotives 12 via a combination of the intra-consist electrical cable, the dedicated data link, and/or other means (e.g., wirelessly), if desired.

Each locomotive 12 can include a car body 22 supported at opposing ends by a plurality of trucks 24 (e.g., two trucks 24). Each truck 24 can be configured to engage a track (not shown) via a plurality of wheels, and to support a frame 26 of car body 22. Any number of engines 28 can be mounted to frame 26 within car body 22 and drivingly connected to a generator 30 to produce electricity that propels the wheels of each truck 24. Engines 28 can be internal combustion engines configured to combust a mixture of air and fuel. The fuel can include a liquid fuel (e.g., diesel) provided to engines 28 from a tank 32 located onboard each locomotive 12 or via fluid couplings 18, and/or a blended mixture of the liquid and gaseous fuels.

Figure 2:
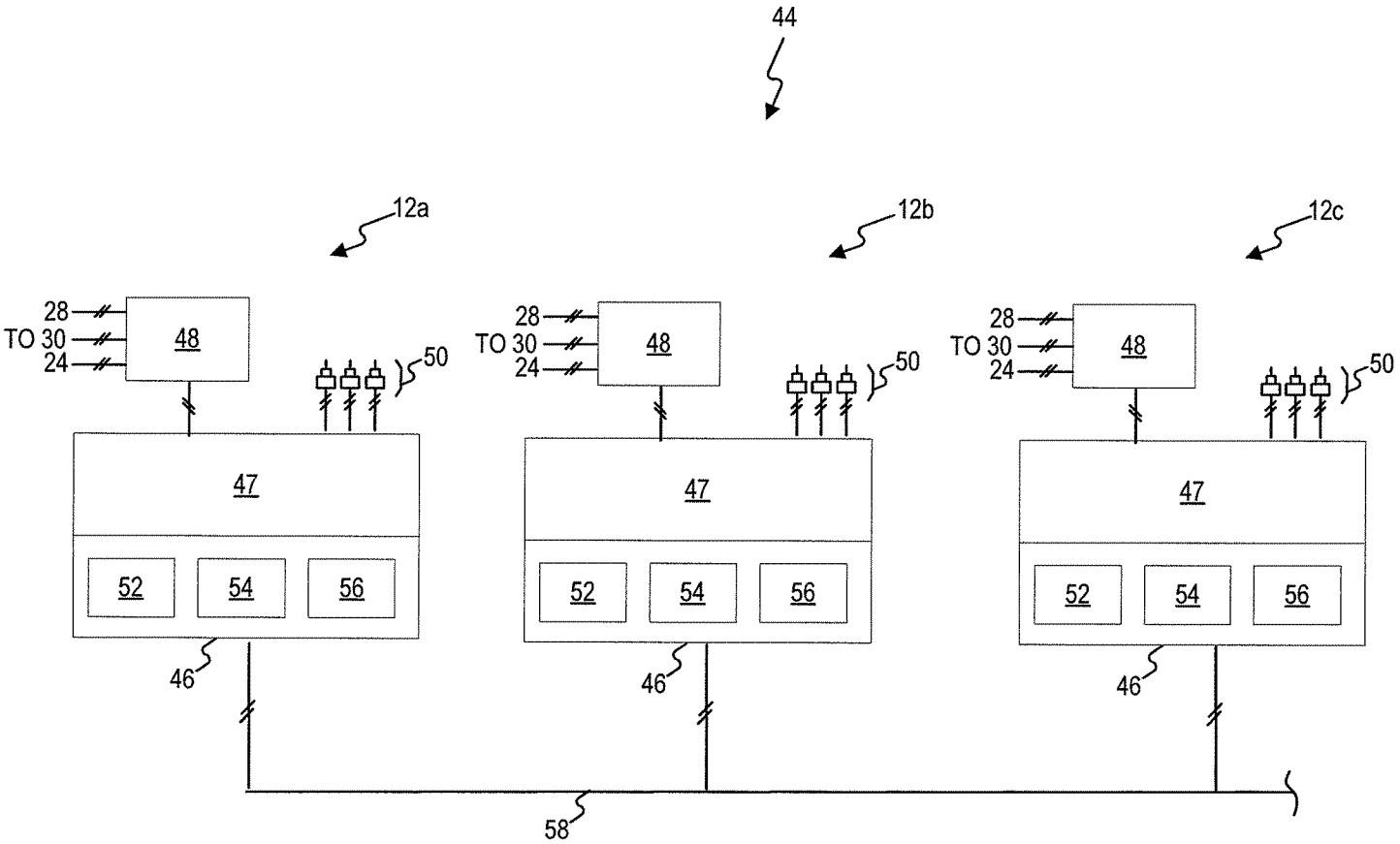
FIG. 2 is a diagrammatic illustration of an exemplary disclosed communication system that may be used in conjunction with the consist of FIG. 1.

As shown in FIG. 2, consist 10 can be equipped with a communication system 44 that facilitates coordinated control of locomotives 12. Communication system 44 can include, among other things, an access point 46 for each locomotive 12. Each access point 46 can be connected to one or more wired and/or wireless networks, and used to communicate command signals and/or data between controllers 48 of each rail vehicle and various other network components 50 (e.g., sensor, valves, pumps, heat exchangers, accumulators, regulators, actuators, GPS components, etc.) that are used to control locomotives 12. Access points 46 can be connected to each other via electrical couplings 20 (e.g., via the intra-consist electrical cable, via the dedicated data link, and/or wirelessly). Access points 46 can be connected to a local area network hub ("LAN hub") 47 that facilitates communication between the controllers 48, the network components 50, and access points 46.

Each access point 46 can include an inter-consist router ("IC router") 52, an Ethernet bridge 54, and an MU modem 56, as well as conventional computing components known in the art (not shown) such as a processor, input/output (I/O) ports, a storage, a memory. The I/O ports may facilitate communication between the associated access point 46 and the LAN hub 47. In some embodiments, the I/O ports may facilitate communication between the associated access point 46 and one or more of network components 50.

Likewise, IC router 52 can facilitate communication between different access points 46 of locomotives 12 that are connected to each other via electrical couplings 20. In some embodiments, IC router 52 can provide a proxy IP address corresponding to controllers 48 and network components 50 of remote locomotives. For example, IC router 52 can provide a proxy IP address for one of network components 50 of locomotive 12*b* so controller 48 of locomotive 12*a* can communicate with it. The IC router 52 can include, or be connected to, an Ethernet bridge 54 that can be configured to translate network data to an electrical signal capable of being sent through intra-consist electrical cable 58. Ethernet bridge 54 can include or be connected to MU modem 56. MU modem 56 can be configured to modulate a carrier signal sent over intra-consist electrical cable 58 with the electrical signal received from Ethernet bridge 54 to transmit network data between access points 46. MU modem 56 can also be configured to demodulate signals received from access points 46 and send the demodulated signals to Ethernet bridge 54 for conversion to network data destined to controller 48 or network components 50. In some embodiments, MU modem 56 sends network data orthogonal to data traditionally transmitted over intra-consist electrical cable 58 (e.g., control data). Although FIG. 2 illustrates IC router 52, Ethernet bridge 54, and MU modem 56 as separate components, in some embodiments, one component can perform the functionality of two components. For example, Ethernet bridge 54 may perform the operations described above with respect to IC router 52, or Ethernet bridge 54 can include, or perform the operations of, MU modem 56.

In some embodiments, access point 46, IC router 52, Ethernet bridge 54, and/or MU modem 56 can include a processor, storage, and/or memory (not shown). The processor can include one or more processing devices, such as microprocessors and/or embedded controllers. The storage can include volatile or non-volatile, magnetic, semiconductor, tape, optical, removable, non-removable, or other type of computer-readable medium or computer-readable storage device. The storage can be configured to store programs and/or other information that can be used to implement one or more of the processes discussed below. The memory can include one or more storage devices configured to store information.

Each controller 48 can be configured to control operational aspects of its related rail vehicle. For example, controller 48 of lead locomotive 12*a* can be configured to control operational aspects of its corresponding engine 28, generator 30, traction motors, operator displays, and other associated components. Likewise, the controllers 48 of trail locomotives 12*b* and 12*c* can be configured to control operational aspects of their corresponding engines 28, generators 30, traction motors, operator displays, and other associated components. In some embodiments, controller 48 of lead locomotive can be further configured to control operational aspects of trail locomotives 12*b* and 12*c*, if desired. For example, controller 48 of lead locomotive 12*a* can send commands through its access point 46 to the access points of trail locomotives 12*b* and 12*c*.

Each controller 48 can embody a single microprocessor or multiple microprocessors that include a means for controlling an operation of the associated rail vehicle based on information obtained from any number of network components 50 and/or communications received via access points 46. Numerous commercially available microprocessors can be configured to perform the functions of controller 48. Controller 48 can include a memory, a secondary storage device, a processor, and any other components for running an application. Various other circuits may be associated with controller 48 such as power supply circuitry, signal conditioning circuitry, solenoid driver circuitry, and other types of circuitry.

The information obtained by a particular controller 48 via access points 46 and/or network components 50 can include performance related data associated with operations of each locomotive 12 ("operational information"). For example, the operational information can include engine related parameters (e.g., speeds, temperatures, pressures, flow rates, etc.), generator related parameters (e.g., speeds, temperatures, voltages, currents, etc.), operator related parameters (e.g., desired speeds, desired fuel settings, locations, destinations, braking, etc.), liquid fuel related parameters (e.g., temperatures, consumption rates, fuel levels, demand, etc.), gaseous fuel related parameters (e.g., temperatures, supply rates, fuel levels, etc.), and other parameters known in the art.

The information obtained by a particular controller 48 via access points 46 and/or network components 50 can also include identification data of the other rail vehicles within the same consist 10. For example, each controller 48 can include stored in its memory the identification of the particular rail vehicle with which controller 48 is associated. The identification data can include, among other things, a type of rail vehicle (e.g., make, model, and unique identification number), physical attributes of the associated rail vehicle (e.g., size, load limit, volume, power output, power requirements, fuel consumption capacity, fuel supply capacity, etc.), and maintenance information (e.g., maintenance history, time until next scheduled maintenance, usage history, etc.). When coupled with other rail vehicles within a particular consist 10, each controller 48 can be configured to communicate the identification data to the other controllers 48 within the same consist 10. Each controller 48, can be configured to selectively affect operation of its own rail vehicle based on the obtained identification data associated with the other rail vehicles of consist 10.

In some embodiments, controllers 48 can be configured to affect operation of their associated rail vehicles based on the information obtained via access points 46 and/or network components 50 and one or more maps stored in memory. Each of these maps may include a collection of data in the form of tables, graphs, and/or equations. Controllers 48 can be configured to affect operation of their associated locomotives based on the position within a locomotive consist. The position of the locomotive associated with controller 48 can be used with the one or more maps to control the operation of the locomotive. For example, a map of throttle settings can be stored in the memory of controller 48. The map of throttle settings can include a mapping of consist position to throttle setting. For example, when the locomotive of controller 48 is the lead locomotive (e.g., in first position in the consist) the map may indicate that controller 48 should set the throttle to Notch 4, and when the locomotive of controller 48 is the third trail locomotive (e.g., in fourth position in the consist), the map may indicate that controller 48 should set the throttle to Notch 2.

According to some embodiments, access points 46 can include one or more components for communicating network data in parallel over intra-consist electrical cable 58. Transmission of network data in parallel can increase the throughput of data of communication system 44. In conventional embodiments, access points 46 communicate network data over a single pair of wires of the intra-consist electrical cable. Further, in conventional embodiments, access points 46 include one communication module (e.g., MU modem 56 and its associated processor and other computing components) and accordingly only one set of network data can be modulated or demodulated at one time. Thus, it can be advantageous for access points 46 to include multiple communication modules that are each capable of modulating and demodulating network data for transmission over intra-consist electrical cable 58.

Figure 3:
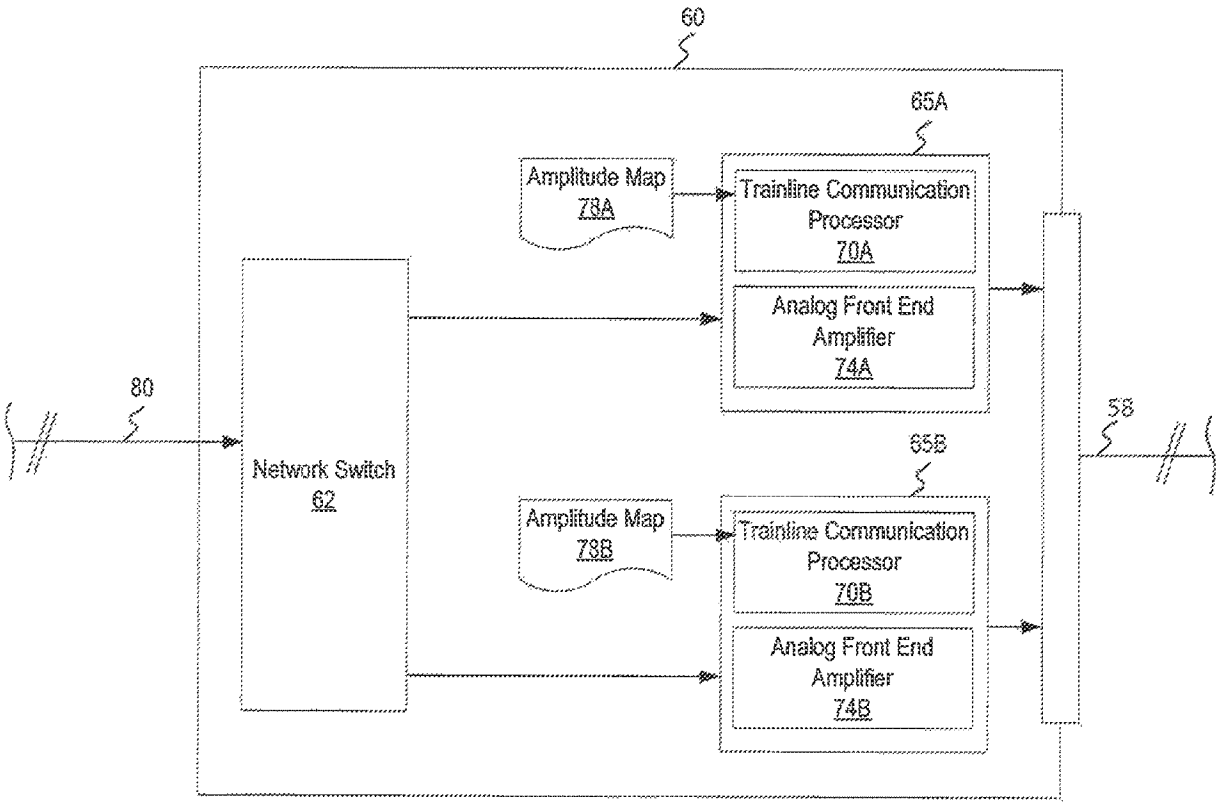
FIG. 3 is a diagrammatic illustration of an exemplary trainline communication network access point for use with the communication system of FIG. 2.

FIG. 3 is an illustration of an exemplary trainline communication network access point 60 for use within communication system 44. For ease of discussion, FIG. 3 discloses exemplary components of trainline communication network access point 60 that can be used to send multiple sets of network data in parallel, but trainline communication network access point 60 can contain additional components that are not described with respect to FIG. 3. For example, trainline communication network access point 60 can contain one or more components of access point 46 as described above with respect to FIG. 2, such IC router 52 and/or Ethernet bridge 54. Further, one or more components of trainline communication network access point 60 can be disposed within one of the components of access point 46 as described above. For example, the communication modules 65*a*, 65*b* of trainline communication network access point 60 could be disposed within IC router 52, Ethernet bridge 54, or MU modem 56. In some embodiments, trainline communication network access point 60 can include a motherboard with one or more expansion slots for accepting daughtercards to enhance its functionality, and the operation of one or more components of trainline communication network access point 60 can be embodied on a daughtercard configured to interface with the motherboard.

According to some embodiments, trainline communication network access point 60 operates to increase bandwidth of communication system 44 by transmitting multiple sets of network data in parallel. Trainline communication network access point 60 can include several components for performing operations such as network switch 62, communication modules 65*a*, 65*b*, and intra-consist electrical cable connection point 76. Although FIG. 3 illustrates communication network access point 60 having two communication modules 65*a*, 65*b*, trainline communication network access point 60 can include any number of communications modules configured to perform the operations disclosed herein. For example, trainline communication network access point 60 can include three, four, or five communication modules each capable of transmitting network data via intra-consist electrical cable 58 in parallel.

Trainline communication network access point 60 can include network data signal path 80, which is a signal path configured to transmit network data received by trainline communication network access point 60 to its internal components. For example, network data received from LAN hub 47 can be transmitted to network switch 62 of trainline communication network access point 60 via network data signal path 80.

Trainline communication network access point 60 can include network switch 62. Network switch 62 can receive network data (e.g., via network data signal path 80) and route it to either second communication module 65*a*, 65*b* for modulation and transmission over intra-consist electrical cable 58. In some embodiments network switch 62 routes network data packets to communication modules in a round robin fashion. For example, network switch 62 can route the first network data packet it receives to communication module 65*a*, the second network data packet it receives to communication module 65*b*, the third network data packet it receives to communication module 65*a*, the fourth network data packet it receives to communication module 65*b*, and so on. In some embodiments, communication modules can send a ready signal to network switch 62 informing network switch 62 that they are ready to send another packet of modulated network data over intra-consist electrical cable 58. When network switch 62 receives the ready signal, it can add the communication module sending the ready signal to a ready queue. When network switch 62 receives network data, it can route it to the next module in the queue. For example, network switch 62 can receive a ready signal from communication module 65*a* and then from communication module 65*b*. The order of the ready queue can be communication module 65*a* and then communication module 65*b*. Network switch 62 receives two network packets of data, and routes the first to communication module 65*a* and the second to communication module 65*b*. Communication module 65*b* then sends a ready signal to network switch 62 before communication module 65*a* sends a ready signal, putting communication module 65*b* to the front of the ready queue. Thus, network switch 62 can send the next packet of network data it receives to second communication module 65*b*, even though that was the last communication module to which it sent a packet of network data.

In some embodiments, network switch 62 can include a redundancy feature to provide more robustness and accuracy to communication system 44. When network switch 62 receives network data on network data signal path 80 (e.g., from LAN hub 47), it can send the network data to communication module 65*a* and send a copy of the network data to communication module 65*b*. Thus, communication module 65*a* and communication module 65*b* would modulate and transmit identical network data. By sending multiple copies of modulated network data over intra-consist electrical cable 58, trainline communication network access point 60 can eliminate loss of data that can occur when modulated network data is corrupted or subject to interference as it is communicated on intra-consist electrical cable 58. In embodiments where network switch 62 is configured for redundant transmission of network data, it can also be configured for redundant receipt of network data. For example, network switch 62 can perform operations to discard copies of demodulated network data so that only one copy of demodulated network data is sent to LAN hub 47.

Trainline communication network access point 60 can also include multiple communication modules 65*a*, 65*b*. For example, FIG. 3 illustrates one embodiment of trainline communication network access point 60 with two communication modules. Communication modules 65*a*, 65*b* can be configured to perform the operations to convert network data to an analog signal that is capable of being transmitted over intra-consist electrical cable 58. For example, communication modules 65*a*, 65*b* can receive packets of network data, translate the network packet data to an analog signal, modulate the analog signal to a carrier frequency, amplify the analog signal (if needed), and send the signal through intra-consist electrical cable connection port 76 to intra-consist electrical cable 58. In some embodiment, communication modules 65*a*, 65*b* include trainline communication processors 70*a*, 70*b* and analog front end amplifiers 74*a*, 74*b*. Trainline communication processors 70*a*, 70*b* can perform operations to enable trainline communication network access point 60 to perform network communications over intra-consist electrical cable 58. For example, trainline communication processors 70*a*, 70*b* can receive network data from LAN hub 47 and modulate the received data for communication over intra-consist electrical cable 58. Further, trainline communication processors 70*a*, 70*b* can receive signals from intra-consist electrical cable 58 and demodulate the receives signals to network data for communication to LAN hub 47. Analog front end amplifiers 74*a*, 74*b* can amplify signals before they are sent to intra-consist electrical cable connection point 76 for communication over intra-consist electrical cable 58. Analog front end amplifiers 74*a*, 74*b* can also attenuate signals as they are received from intra-consist electrical cable connection point 76 in the event the signals are too strong to be handled by trainline communication processors 70*a*, 70*b*.

Trainline communication processors 70*a*, 70*b* can also be configured to encrypt and decrypt network data before modulating it to a signal for transmission over intra-consist electrical cable 58. In some embodiments, trainline communication processor 70*a* uses first encryption keys and trainline communication processor 70*b* uses second encryption keys. The use of encryption keys can enable more accurate parallel communication of network data because if modulated network data becomes corrupted as it is transmitted over intra-consist electrical cable 58, trainline communication processors 70*a*, 70*b* will not be able to properly decrypt it. Accordingly, trainline communication processors 70*a*, 70*b* can discard the data. In embodiments using encryption, trainline communication processors 70*a*, 70*b* of one locomotive (e.g., locomotive 12*a*) can be paired with trainline communication processors 70*a*, 70*b* of a second locomotive (e.g., locomotive 12*b*). The pairing can be done using configuration files, network communications, or any known method of establishing an encrypted communication.

In some embodiments, trainline communication processors 70*a*, 70*b* can perform or control operations for modulating or demodulating signals that communicate network data over intra-consist electrical cable 58 based on amplitude maps 78*a*, 78*b*. Amplitude maps 78*a*, 78*b* can include a data structure specifying the amplitudes of frequencies that trainline communication processors 70*a*, 70*b* use for modulation in communication system 44. Amplitude maps 78*a*, 78*b* can be a data structure stored in memory, a database, or a configuration file, for example, that is accessible locally or remotely by trainline communication processors 70*a*, 70*b*. When trainline communication processors 70*a*, 70*b* generate a data signal capable of transmitting network data over intra-consist electrical cable 58, the processors can refer to amplitude maps 78*a*, 78*b* to determine the proper amplitude for the data signal. In some cases, it can be desirable to configure a trainline communication processor to not use a particular frequency for modulation or demodulation. To prevent a trainline communication processor from using a frequency, the corresponding amplitude for the frequency can be set to zero in the amplitude map, a process referred to as "notching" the frequency. Trainline communication network access point 60 can use notching to achieve frequency division, as described below.

In some embodiments, trainline communication network access point 60 includes intra-consist electrical cable connection point 76. Intra-consist electrical cable connection point 76 can include one or more electrical contacts that enable one or more communication modules to interface, transmit signals to, and receive signals from intra-consist electrical cable 58. Typically, intra-consist electrical cable 58 includes twenty seven separate wires, and any pair of wires can be used to transmit modulated network data. In some embodiments, intra-consist electrical cable connection point 76 connects communication modules 65*a*, 65*b* to one pair of wires of intra-consist electrical cable 58, and communication modules 65*a*, 65*b* modulate network data and transmit it using the same pair of wires using a frequency division scheme. The frequency division scheme can include a block of frequencies. For example, communication module 65*a* can use the low frequencies and communication module 65*b* can use high frequencies. In some embodiments, the frequency division can be interleaved. For example, communication module 65*a* can use odd frequencies, and communication module 65*b* can use even frequencies. In some embodiments, the frequency division can be block-interleaved. As indicated above, amplitude maps 78*a*, 78*b* can be configured to notch frequencies according to the frequency division scheme. For example, in an interleaved frequency division scheme where communication module 65*a* uses odd numbered frequencies, the even numbered frequencies can be notched in its corresponding amplitude map 78*a*, and in an interleaved frequency division scheme where communication module 65*b* uses even numbered frequencies, the odd numbered frequencies can be notched in its corresponding amplitude map 78*a*

In some embodiments, communication module 65*a* sends modulated network data over one pair of wires of intra-consist electrical cable 58 and communication module 65*b* sends modulated network data over a second pair of wires of intra-consist electrical cable 58. In such embodiments, intra-consist electrical cable connection point 76 can connect the output of communication module 65*a* to a first pair of wires of intra-consist electrical cable 58 and it can connect the output of communication module 65*b* to a second pair of wires of intra-consist electrical cable 58. When communication module 65*a* and communication module 65*b* transmit signals over different pairs of wires of intra-consist electrical cable 58, they can also utilize a frequency division scheme, if desired. Also, when communication modules 65*a*, 65*b* transmit signals over different pairs of wires of intra-consist electrical cable 58, they can also use an encryption keys in addition to, or in lieu of, a frequency division scheme. Further operations of trainline communication network access point 60 are described in greater detail below with respect to FIG. 4.

INDUSTRIAL APPLICABILITY

The disclosed trainline network access point can be applicable to any locomotive consist that includes a communication system. The disclosed trainline network access point can provide greater throughput of data as it is configured to utilize more than one communication module for transmitting communications over an intra-consist electrical cable. The operation of the disclosed trainline network access point will now be explained.

Figure 4:
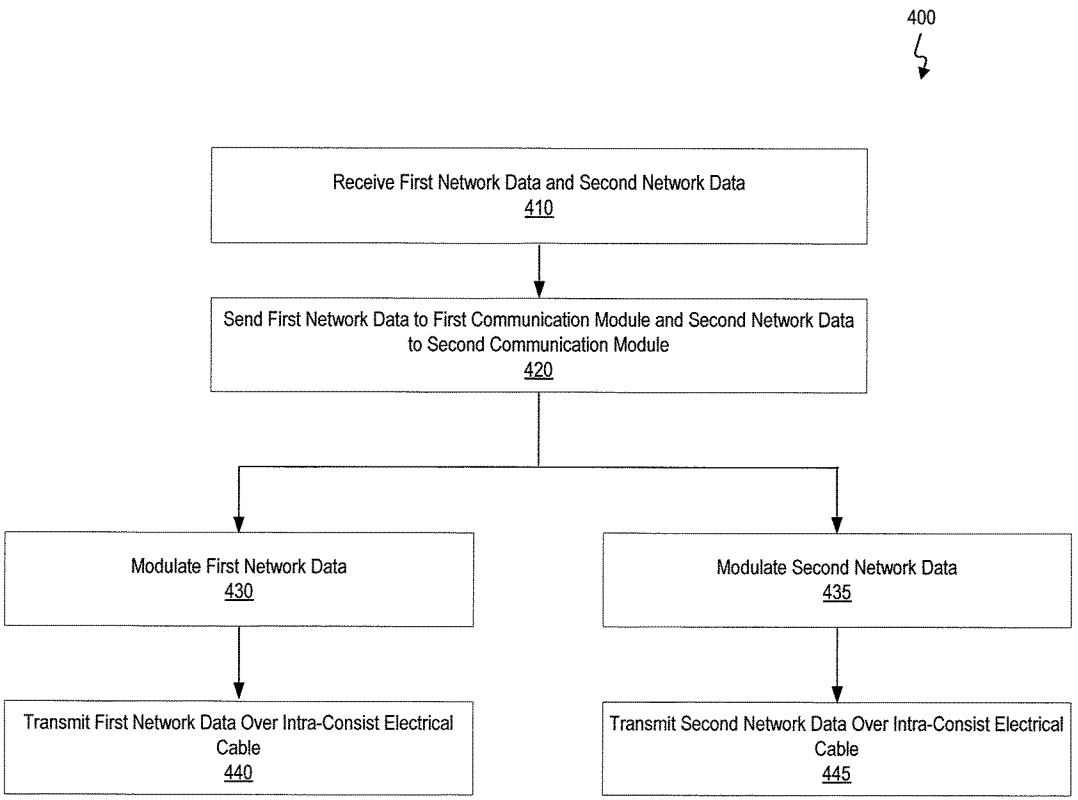
FIG. 4 is a flowchart illustrating an exemplary disclosed method for filtering data signals that can be performed by the trainline communication network access point of FIG. 3.

FIG. 4 is a flowchart illustrating an exemplary disclosed method 400 for transmitting parallel network data over an intra-consist electrical cable that can be performed by one or more of the components illustrated in FIG. 3. For example, during the operation of consist 10, trainline communication network access point 60 can perform method 400 to transmit network data packets in parallel. Although the description that follows describes method 400 as being performed by trainline communication network access point 60, other components of access point 46 can perform one or more of the steps of method 400 in some embodiments.

Trainline communication network access point 60 begins method 400 by receiving first network data and second network data (step 410). For example, the first network data can be a first network data packet that is addressed to a component of a first locomotive (e.g., locomotive 12*a*) and the second network data can be a second network data packet that is addressed to a component of a second locomotive (e.g., locomotive 12*b*). When trainline communication network access point 60 receives the first network data and the second network data, network switch 62 can send them to one or more communication modules (step 420). For example, network switch 62 can route the first network data to a first communication module (e.g., communication module 65*a*) and can route the second network data to a second communication module (e.g., communication module 65*b*).

Once the first and second network data have been routed to their respective communication modules, method 400 can proceed in parallel. For example, communication module 65*a* can perform steps 430, and 440 of method 400 while at the same time communication module 65*b* can perform steps 435, and 445. Once the communication modules receive network data, they can modulate it (step 430, 435). The communication modules can modulate the data by referencing their respective amplitude maps to determine an available carrier frequency. In some embodiment, the communication modules can also encrypt the network data before or after modulation. Once modulated, the communication modules send the modulated data to intra-consist electrical cable connection point 76 so that is can be transmitted over intra-consist electrical cable 58 to its appropriate destination (step 440, 445).

Several advantages over the prior art may be associated with the disclosed trainline network access point. The disclosed trainline network access point can provide greater throughput of data as it is configured to utilize more than one communication module for transmitting parallel communications over one pair of wires of the intra-consist electrical cable, or multiple pairs of wires of the intra-consist electrical cable. In addition, the disclosed trainline network access point can provide greater accuracy of network data transmissions over intra-consist electrical cables through the use of redundant transmissions.

It will be apparent to those skilled in the art that various modifications and variations can be made to the trainline network access point. Other embodiments will be apparent to those skilled in the art from consideration of the specification and practice of the disclosed trainline network access point. It is intended that the specification and examples be considered as exemplary only, with a true scope being indicated by the following claims and their equivalents.

What is claimed is:

1. A trainline network access point connected to an intra-consist electrical cable of a consist, the trainline network access point comprising:

a network data signal path;

a first communication module;

a second communication module; and a network switch connected to the first communication module and the second communication module and configured to selectively add at least one of the first communication module and the second communication module to a ready queue upon receiving a signal from a respective one of the first communication module and the second communication module indicating that the respective one of the first communication module or the second communication module is ready to receive the network data and to selectively connect the network data signal path to one of the first communication module and the second communication module based on the ready queue;

wherein the first communication module comprises a first processor, the first processor configured to:

receive first network data via the network data signal path, modulate the first network data for transmission over the intra-consist electrical cable, and transmit the first modulated network data over the intra-consist electrical cable, wherein the second communication module comprises a second processor, the second processor configured to:

receive second network data via the network data signal path, modulate the second network data for transmission over the intra-consist electrical cable, and transmit the second modulated network data over the intra-consist electrical cable.

2. The trainline network access point of claim 1, wherein the first network data is modulated using a first group of frequencies, and the second network data is modulated using a second group of frequencies.

3. The trainline network access point of claim 2, wherein the first group of frequencies is defined in a first amplitude map and the second group of frequencies is defined in a second amplitude map.

4. The trainline network access point of claim 3, wherein the first group of frequencies is interleaved with the second group of frequencies.

5. The trainline network access point of claim 1, wherein the first processor is further configured to encrypt the first network data and the second processor is further configured to encrypt the second network data.

6. The trainline network access point of claim 1 wherein the first network data and the second network data are the same.

7. The trainline network access point of claim 6 wherein the network switch is configured to copy the first network data to create the second network data.

8. A method of transmitting data over an intra-consist electrical cable using a trainline network access point having a first communication module, a second communication module, and a network switch, the method comprising:

receiving network data;

adding, using the network switch, at least one of the first communication module and the second communication module to a ready queue upon receiving a signal from a respective one of the first communication module and the second communication module indicating that the respective one of the first communication module or the second communication module is ready to receive the network data;

selecting, using the network switch, a communication module from the ready queue;

selectively sending the network data to the selected communication module using the network switch;

modulating, with the selected communication module, the network data for transmission over the intra-consist electrical cable; and transmitting the modulated network data over the intra-consist electrical cable.

9. The method of claim 8, wherein the network data includes first network data and second network data, the first network data is modulated using a first group of frequencies, and the second network data is modulated using a second group of frequencies.

10. The method of claim 9, wherein the first group of frequencies is defined in a first amplitude map and the second group of frequencies is defined in a second amplitude map.

11. The method of claim 9, wherein the first group of frequencies is interleaved with the second group of frequencies.

12. The method of claim 9, wherein the modulated first network data and the modulated second network data are transmitted over a same pair of wires of the intra-consist electrical cable.

13. The method of claim 9, wherein the modulated first network data is transmitted over a first pair of wires of the intra-consist electrical cable and the modulated second network data is transmitted over a second pair of wires of the intra-consist electrical cable.

14. The method of claim 9, further including:

encrypting the first network data with a first encryption key; and, encrypting the second network data with a second encryption key.

15. The method of claim 9 wherein the first network data and the second network data are the same.

16. The method of claim 9 further including copying the first network data to create the second network data.

17. A locomotive consist comprising:

a locomotive;

an intra-consist electrical cable;

a trainline network access point disposed within the locomotive and connected to the intra-consist electrical cable and including:

a network data signal path;

a first communication module;

a second communication module;

a network switch connected to the first communication module and the second communication module and configured to selectively add at least one of the first communication module and the second communication module to a ready queue upon receiving a signal from a respective one of the first communication module and the second communication module indicating that the respective one of the first communication module or the second communication module is ready to receive the network data and to selectively connect the network data signal path to one of the first communication module and the second communication module based on the ready queue;

wherein the first communication module comprises a first processor, the first processor configured to:

receive first network data via the network data signal path, determine first frequencies from a first amplitude map, modulate the first network data for transmission over the intra-consist electrical cable using one of the first frequencies, and transmit the modulated first network data over the intra-consist electrical cable;

wherein the second communication module comprises a second processor, the second processor configured to:

receive second network data via the network data signal path, determine second frequencies from a second amplitude map, modulate the second network data for transmission over the intra-consist electrical cable using one of the second frequencies, and transmit the modulated second network data over the intra-consist electrical cable.

* * * * *